US006053100A

United States Patent [19]

Uchiyama et al.

[11] Patent Number: 6,053,100

[45] Date of Patent: Apr. 25, 2000

[54] STENCIL PRINTING MACHINE WITH PRESSURE REDUCTION CHAMBER

[75] Inventors: Koichi Uchiyama; Junnosuke Katsuyama, both of Ibaraki-ken, Japan

[73] Assignee: Riso Kagaku Corporation, Tokyo, Japan

[21] Appl. No.: 09/288,630

[22] Filed: Apr. 9, 1999

[30] Foreign Application Priority Data

Apr. 13, 1998 [JP] Japan ..... 10-101333

[51] Int. Cl.[7] ..... B41F 15/20; B41F 15/22

[52] U.S. Cl. ..... 101/114; 101/126; 101/127; 101/127.1

[58] Field of Search ..... 101/126, 127, 101/127.1, 114, 129; 417/229, 234; D23/231

[56] References Cited

U.S. PATENT DOCUMENTS 5,365,656 11/1994 Dahringer et al. ..... 29/840
5,596,925 1/1997 Hasegawa ..... 101/127.1
5,876,498 3/1999 Thompson, Sr. ..... 118/64
5,943,953 8/1999 Oleson ..... 101/114

FOREIGN PATENT DOCUMENTS 0 615 842 9/1994 European Pat. Off. .
0 842 770 5/1998 European Pat. Off. .

*Primary Examiner*—John S. Hilten
*Assistant Examiner*—Daniel J. Colilla
*Attorney, Agent, or Firm*—Kanesaka & Takeuchi

[57] ABSTRACT

A stencil printing machine includes a main body; a covering openably attached to a surface of the main body and enclosing a space between the main body and the covering for storing a printing sheet and a stencil sheet therein; a flexible sheet attached to the covering so as to face the stencil sheet; a pressure reducing device disposed under the main body so as to communicate with the space and reducing pressure in the space; and a manual operating device for operating the pressure reducing device when being pressed downwardly from an operation start position that is substantially in the same level as the covering.

5 Claims, 9 Drawing Sheets

STENCIL PRINTING MACHINE WITH PRESSURE REDUCTION CHAMBER

BACKGROUND OF THE INVENTION

1. Field of the Invention

The present invention relates to a stencil printing machine. The stencil printing machine of the present invention includes a stencil sheet and a pressure chamber for storing the stencil sheet and a printing sheet. Pressure reducing means is connected to the pressure chamber for reducing pressure inside the pressure chamber. A part of wall-structure of a the pressure chamber is composed of a flexible sheet material. When the pressure reducing means reduces pressure inside the pressure chamber, atmospheric pressure exerts on ink via the flexible sheet material. The ink is transferred to the printing sheet through perforations of the stencil sheet, thereby conducting printing.

2. Description of the Related Art

In Japanese Laid Open Publication No. 6-270523, the present applicant has been proposed a basic concept of a pressure type stencil printing machine that is provided with such a pressure chamber. The stencil printing machine is provided with a pressure chamber, and a wall-structure which is partly composed of a flexible diaphragm device. To the pressure chamber, pressure reducing means is connected. The pressure type stencil printing machine is capable of conducting stencil printing easily and quickly at a predetermined and constant printing-density even in the case where a printing area is large.

In such stencil printing machine, however, the pressure chamber is inevitably enlarged and pressure reducing means of a large capacity is required if the machine is applied to a large printing area. Such pressure reducing means of a large capacity may be a vacuum pump, especially one provided with a motor blower. In the case where such pressure reducing means is adopted, following problems arise. Firstly, the whole of the printing machine is large. Further, much time is consumed until printing pressure reaches an appropriate level for printing since the pressure reduction is conducted at a constant speed. Further, a fine control of the printing pressure is difficult to be conducted. Much operating time is required and the operation is complicated.

An object of the present invention is to provide a stencil printing machine using the above-mentioned pressure reduction, wherein the pressure reduction can be easily and rapidly conducted, the whole machine is small, light and simple, and further operational convenience is improved.

SUMMARY OF THE INVENTION

A stencil printing machine as defined in the first aspect of the present invention comprises a main body; a cover body openably attached to a surface of the main body to form a space between the main body and the cover body for storing a printing sheet and a stencil sheet therein; a flexible sheet attached to the cover body so as to face the stencil sheet; pressure reducing means disposed under the main body so as to communicate with the space to reduce pressure in the space; and manual operating means attached to the pressure reducing means. The manual operating means operates the pressure reducing means when it is pressed downwardly from an operation start position that is substantially in the same level as the cover body.

A stencil printing machine as defined in the second aspect of the present invention comprises a main body having an upper surface for placing a printing sheet thereon; a cover body openably attached to the upper surface of the main body and having a stencil sheet attached thereto, the cover body forming a space between the main body and the cover body for storing the stencil sheet and a printing sheet therein when the cover body is placed on the upper surface of the main body; a flexible sheet attached to an upper surface side of the cover body so as to face the stencil sheet attached to the cover body; pressure reducing means disposed under the main body so as to communicate with the space, the pressure reducing means allowing atmospheric pressure to be exerted on the stencil sheet through the flexible sheet by reducing pressure in the space, thereby closely contacting the stencil sheet with the printing sheet to complete printing; and manual operating means attached to the pressure reducing means. The manual operating means operates the pressure reducing means when it is pressed downwardly from an operation start position that is substantially in the same level as the cover body.

According to a stencil printing machine as defined in the third aspect of the present invention, in the stencil printing machine of the second aspect, the cover body includes a frame having an opening for receiving the stencil sheet, and the flexible sheet is openablly attached to an upper surface of the frame in such a manner that the flexible sheet closes the opening when printing is conducted.

According to a stencil printing machine as defined in the fourth aspect of the present invention, in the stencil printing machine of the third aspect, the frame comprises an upper first frame having a first opening and a lower second frame disposed under the upper first frame and having a second opening, and the second opening is smaller than the first opening and located inside the first opening; the flexible sheet is openablly attached to an upper surface of the first frame in such a manner that the flexible sheet closes the first opening when printing is conducted; the stencil sheet is a stencil sheet assembly comprising a frame having an outer shape fitting in the first opening, a stencil sheet attached to one face of the frame and a cover sheet openablly attached to the other face of the frame; and the stencil sheet assembly is mounted inside the first opening so that the stencil sheet is located at the bottom when printing is conducted.

According to a stencil printing machine as defined in the fifth aspect of the present invention, in the stencil printing machine of the third aspect, an elastic adhesive layer is disposed on either one of the upper surface of the frame and a lower surface of the flexible sheet, and the other one of the upper surface of the frame and a lower surface of the flexible sheet is made from a resin sheet having a smooth surface.

According to a stencil printing machine as defined in the sixth aspect of the present invention, in the stencil printing machine of the second aspect, the pressure reducing means comprises a swingable bottom plate pivotally attached to a lower surface of the main body at a rear end thereof and an extensible flexible bag disposed between an upper surface of the bottom plate and the lower surface of the main body; the manual operating means is a front end portion of the bottom plate; and the stencil printing machine further comprises return means for setting the bottom plate in the operation start position by urging the bottom plate upward.

According to a stencil printing machine as defined in the seventh aspect of the present invention, in the stencil printing machine of the second aspect, the pressure reducing means comprises an upper plate disposed on the main body, a vertically extendable flexible bag disposed on a lower surface of the upper plate, a bottom plate disposed on a lower side of the bag and an engaging portion disposed on the bottom plate; and the manual operating means is a manual operating lever pivotally attached to a side surface of the main body to be vertically swingable to engage an upper side of the engaging portion; and return means is provided for setting the manual operating lever in the operation start position by urging the bottom plate upward.

DETAILED DESCRIPTION OF PREFERRED EMBODIMENTS

Figure 1:
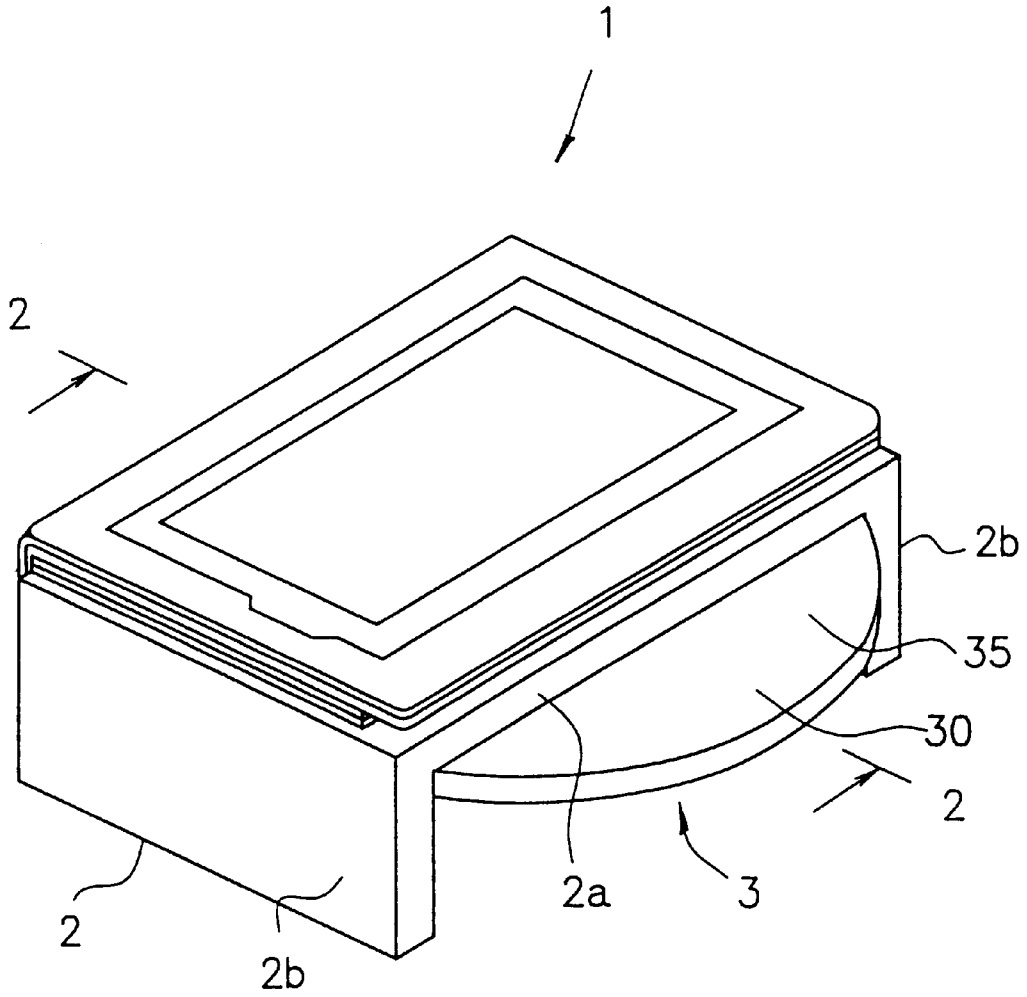
FIG. 1 is a perspective view of a stencil printing machine in the first embodiment of the present invention.
Figure 2:
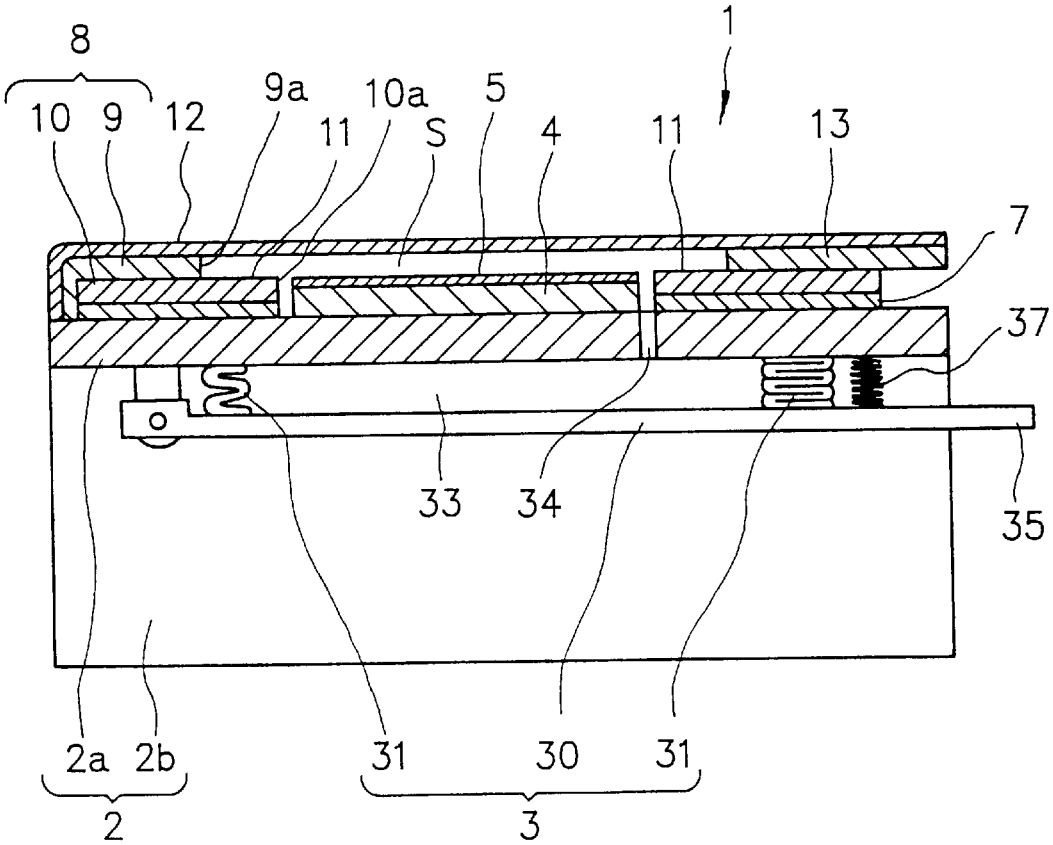
FIG. 2 is a sectional view taken along lines 2—2 of FIG. 1.

FIG. 1 is a perspective view of a stencil printing machine 1 in the first embodiment of the present invention. FIG. 2 is a sectional view taken along lines 2—2 of FIG. 1. A main body 2 includes a horizontal plate portion 2*a* and a pair of vertical support portions 2*b*, 2*b*. Namely, the support portions 2*b*, 2*b* support the plate portion 2*a*, thereby leaving a space between a ground plane and a lower surface of the plate portion. In the space under the plate portion 2*a*, an air pump 3 as pressure reducing means is disposed. The air pump 3 will be explained later. On the center of an upper surface of the plate portion 2*a*, a mounting base 4 is disposed for mounting a printing sheet thereon. The mounting base 4 is composed of elastic material such as sponge. An upper surface of the mounting base 4 is a plane of A4 size, which is appropriate for receiving a sheet-body to be printed such as paper, a plastic sheet and so on. On the upper surface of the mounting base 4, an adhesive layer 5 is formed for holding a printing sheet 6 as a printing body thereon. As shown in FIG. 2, a frame member 7 is disposed on the upper surface of the main body 2. The frame member 7 surrounds the mounting base 4 at a predetermined gap.

A cover body 8 is openablly attached to the upper surface of the main body 2. As shown in FIG. 2, the cover body 8 is a layered product that is composed of an upper first frame 9 and a second frame 10 on the main body 2 side laminated with each other. A rectangular opening 9*a* of the first frame 9 is larger than a rectangular opening 10*a* of the second frame 10 on the main body 2 side. Accordingly, from a viewpoint on an upper side of the cover body 8, an inner peripheral edge of the second frame 10 protrudes inside the opening 9*a* of the first frame 9, thereby functioning as a shoulder portion 11 for holding a stencil sheet therein. An inner shape of the rectangular opening 9*a* of the first frame 9 conforms to an outer shape of the stencil sheet for stencil printing.

The second frame 10 is composed of a flexible magnetic sheet. The frame member 7 is made from ferromagnetic material. When the cover body 8 is laid on the main body 2, the cover body is closely contacted with the main body, so that there is not much clearance left between them for air leakage.

A flexible sheet 12 is superimposed on an upper surface side of the cover body 8. The cover body 8 and the flexible sheet 12 are swingable relative to the plate portion 2*a* while being connected to an edge of the plate portion 2*a*. Further, the flexible sheet 12 can open relative to the first frame 9. When the flexible sheet 12 is swung upward and separated from the first frame 9, the stencil sheet for stencil printing can be placed on the shoulder portion 11.

An elastic adhesive layer 13 is provided with an upper surface of the first frame 9. The flexible sheet 12 is composed of a resin sheet, such as a polyvinyl chloride sheet, with a high degree of smoothness. Accordingly, when the flexible sheet 12 is laid on the first frame 9, the flexible sheet is closely contacted with the first frame; so that there is not much clearance left between them for air leakage.

In the present embodiment, all of the main body 2, the flexible sheet 12, and the first and the second frames 9, 10 can be composed of plastic materials. In this embodiment, the flexible sheet 12 and the frames 9, 10 are made of chloroethylene sheets in thickness of about 0.5 mm and 5 mm respectively; so that adherence between them is secured. It is desirable that the frames 9, 10 should be made more rigid than the flexible sheet 12. The swingable connection between the cover body 8 and the main body 2 can be so constituted that a folded line or a thin-walled line is made on a part of the flexible sheet 12 adjacent to a connecting portion to the frames 9, 10. In this embodiment, the connecting portion is composed of soft polypropylene; however, the flexible sheet 12 and the frames 9, 10 may be connected to the main body 21 with a hinge.

Accordingly, when the cover body 8 and the flexible sheet are placed on the main body, a space is formed between the flexible sheet 12 and the main body 2. As shown in FIG. 2, the space is referred to as a pressure reduction chamber S. Simply placing the flexible sheet 12 on the main body 2 secures airtightness of the pressure reduction chamber S relative to the outside. Before placing the flexible sheet 12 on the main body, the stencil sheet for stencil printing and a printing sheet are stored inside the pressure reduction chamber S. Namely, the plate is inserted inside the first frame 9 after opening the flexible sheet 12. The printing sheet is placed on the mounting base 4 after opening the flexible sheet 12.

Figure 3:
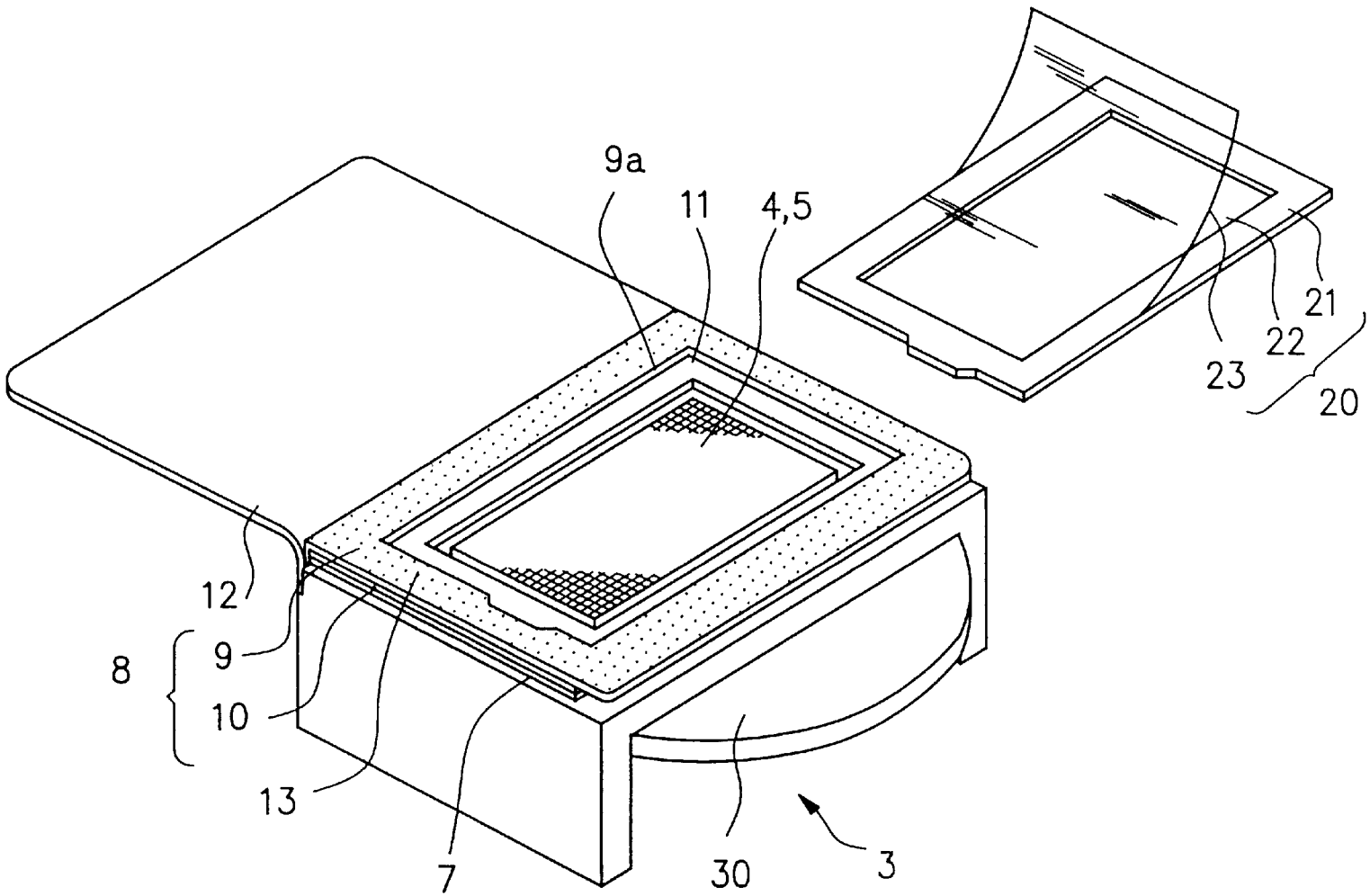
FIG. 3 is a perspective view illustrating a state of opening a flexible sheet in the stencil printing machine of the first embodiment.

A stencil sheet assembly 20 as shown in FIG. 3 is used as the printing plate in the present embodiment. The printing sheet assembly 20 includes a frame 21, a stencil sheet 22 and an ink cover sheet 23. The frame 21 is made of cardboard or plastic. The stencil sheet 22 is attached to one face of the frame 21. The ink cover sheet 23 is ink-impermeable and openablly attached to the other face of the frame 21. Upon perforating the stencil sheet 22, the ink cover sheet 23 is opened and ink is placed on the stencil sheet 22. And then, after closing the ink cover sheet 23, the assembly is provided for printing. The rigid frame 21 is preferable since it is reliably supported and held by the shoulder portion 11. The ink cover sheet 23 may be omitted if not necessary. Further, the stencil sheet assembly 20 may be one having substantially the same constitution as disclosed in Japanese Utility Model Laid Open Publication No. 51-132005. The Official Gazette should be referred to with respect to the details. Further, a heat sensitive stencil sheet can be adopted as the stencil sheet. As the heat sensitive stencil sheet, one composed of a thermoplastic resin film and a porous supporting substance such as Japanese paper or woven fabrics laminated with each other can be adopted.

Figure 5:
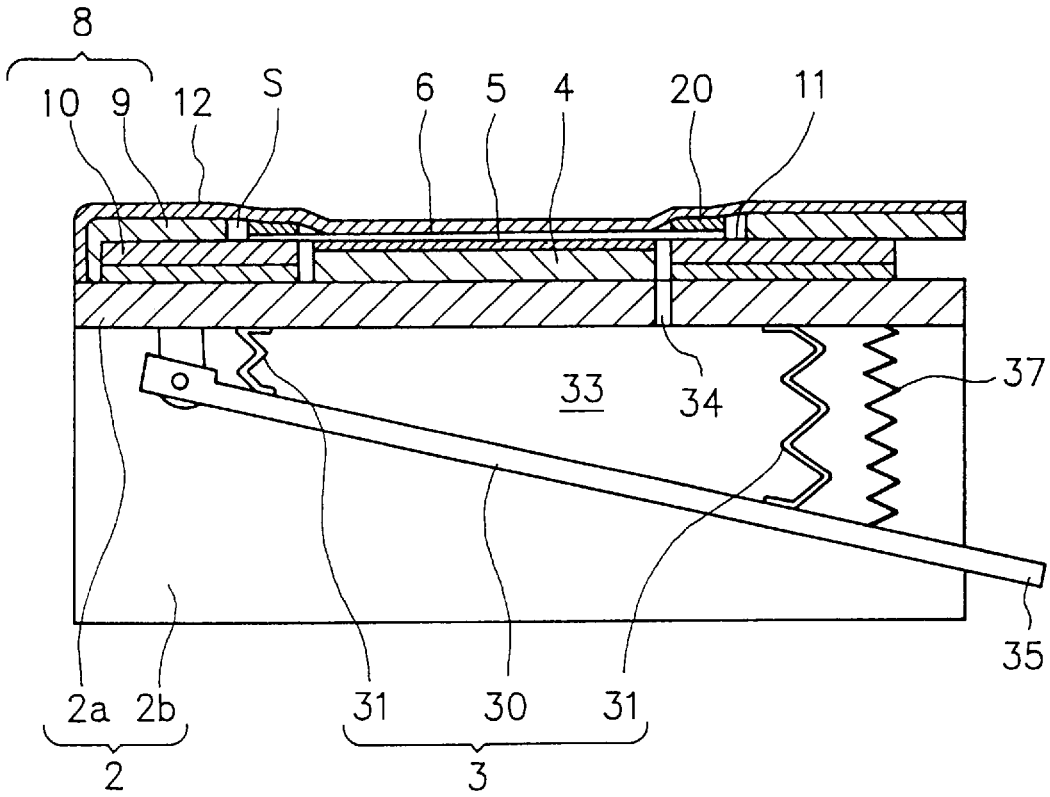
FIG. 5 is a sectional view similar to FIG. 1, but illustrating a state of reducing pressure in a pressure reduction chamber of the stencil printing machine of the first embodiment.

The air pump 3 disposed on the lower side of main body 2 will be explained referring to FIG. 2 and FIG. 5. The air pump 3 has a bottom plate 30 pivotally attached to a rear part of the lower surface of the plate portion 2*a*. The pump also has a flexible bag 31 between the bottom plate 30 and the lower surface of the plate portion 2*a*. The bag is composed of a resin sheet folded in bellows structure and enclosing a space between the bottom plate 30 and the lower surface of the plate portion 2*a*. Vertically swinging the bottom plate 30 causes the bag to expand and shrink in turn like an accordion. An inner space 33 of the bag 31 is connected to the pressure reduction chamber S wherein the printing sheet is placed. When the bottom plate 30 is lowered as shown in FIG. 5, the pressure of the pressure reduction chamber S is reduced. The pressure reduction in the chamber S allows atmospheric pressure to exert on the flexible sheet 12 to deform toward the main body 2, thereby closely contacting the stencil sheet assembly 20 with the printing sheet 6.

A front end portion of the bottom plate 30 of the air pump 3 protrudes beyond the front side of the main body. The portion functions as manual operating means, i.e. a manual operating lever 35, for driving the air pump 3.

Between the manual operating lever 35 and the plate portion 2*a*, a return spring 37 is disposed as return means. As shown in FIG. 2, the return spring 37 holds the bottom plate 30 in a virtually horizontal position. This position is an operation start position of the manual operating lever 35. The manual operating lever 35 in the operation start position is substantially in the same level as that of the closed cover body 8. When the manual operating lever 35 is pressed downward from this position, the return spring 37 is extended. Upon releasing the pressing force, the return spring 37 returns the manual operating lever 35 to the operation start position.

Printing operation conducted by using the present machine will be explained.

Figure 4:
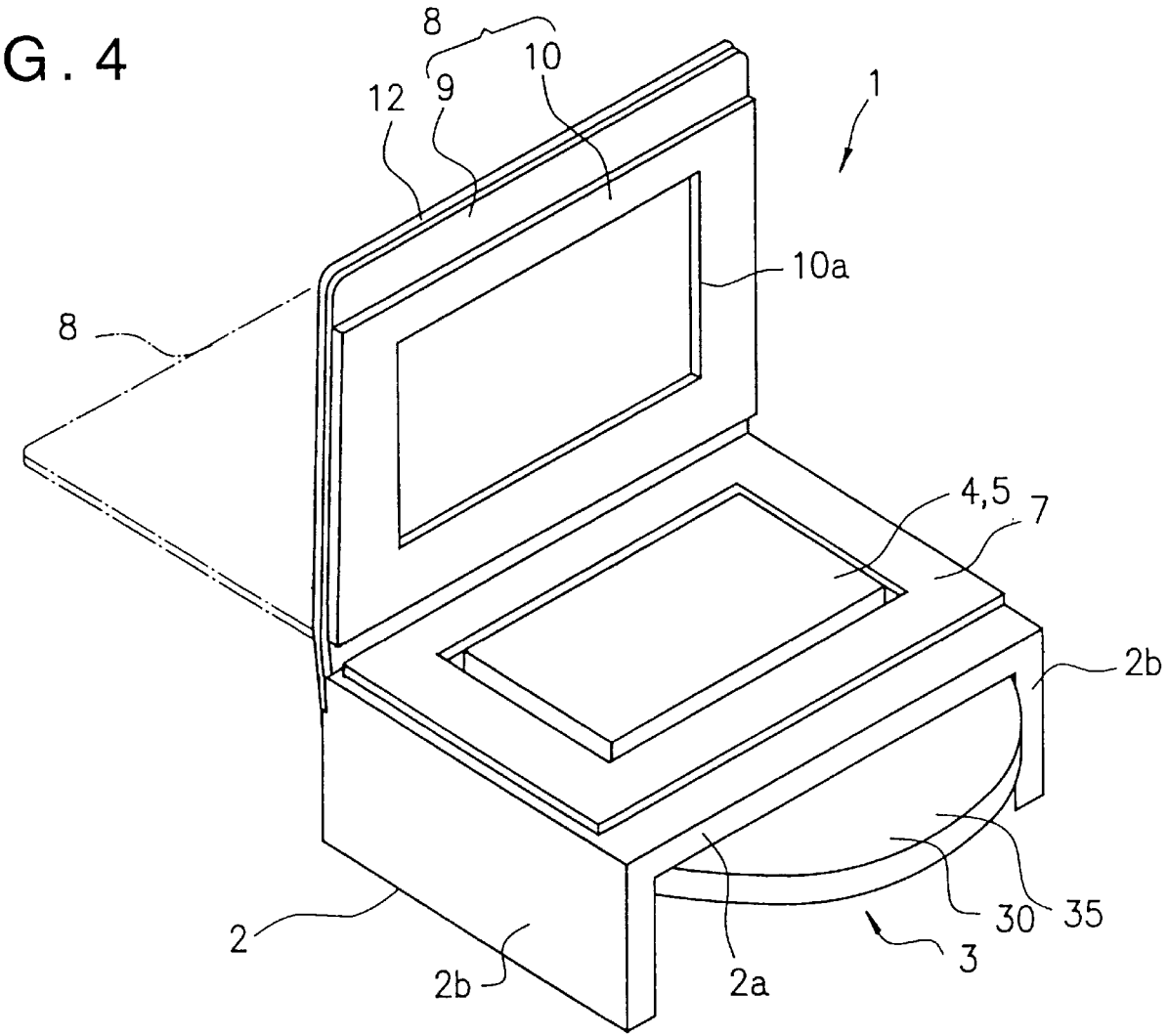
FIG. 4 is a perspective view illustrating a state of opening a cover body in the stencil printing machine of the first embodiment.

As shown in FIG. 3, the flexible sheet 12 is opened upward, and then the perforated stencil sheet assembly 20 with ink is placed in the opening 9*a*. Then, the stencil sheet assembly 20 is supported in such a manner that the frame 21 is in areal contact with the shoulder portion 11. Next, as shown in FIG. 1, the flexible sheet 12 is superimposed on the upper surface of the frame 9 again. The stencil sheet assembly 20 is held by the frame 10 and the flexible sheet 12 while being sandwiched therebetween. As shown in FIG. 4, the entire cover body 8 with the frames 9, 10 is opened upward with the flexible sheet 12. A printing sheet is placed on the mounting base 4.

Next, printing operation is conducted. The cover body 8 with the flexible sheet 12 is swung downward and superimposed on the main body 2. Then, the cover body 8 with the flexible sheet 12 is in the state as shown in FIG. 1 and FIG. 2; however, the stencil sheet assembly 20 is not illustrated in FIG. 2. Next, as shown in FIG. 5, the manual operating lever 35 is pressed downward. The bag 31 extends and the inner space 33 enlarges. Air in the pressure reduction chamber S is transferred to the inner space 33, and pressure in the pressure reduction chamber S is reduced. The flexible sheet 12 is warped by atmospheric pressure, thereby pressing the stencil sheet assembly 20. Ink is pressed and transferred to the printing sheet through the perforations of the stencil sheet 22. Printing is thus conducted.

After printing, the manual operating lever 35 (the bottom plate 30) is released. The manual operating lever 35 (the bottom plate 30) is swung upward by the returns spring 37 and return to the operation start position. The deformed bag 31 shrinks. Air in the inner space 33 returns to the pressure reduction chamber S through connecting hole 34. After the cover body 8 with the flexible sheet 12 opens, the printing sheet is took out.

When ink must be supplied after conducting printing many times, the stencil sheet assembly 20 is took out of the frame after the flexible sheet 12 is opened, as shown in FIG. 3, and then ink is supplied thereto.

Ink used here is preferably printing ink of emulsion type described in Japanese Patent Publication No. 54-23601. The ink has viscosity of under 32 degrees on the spread meter at one-minute value; therefore, it is capable of self-holding its shape. Further, the ink may have thixotropy.

The present machine is so designed that only one stroke of the manual operating lever 35 can attain a necessary pressure reduction in the pressure reduction chamber S on main body 2 side. Namely, the air pump 3 is so constituted that stroke volume thereof exceeds that of the pressure reduction chamber S. Thus, in the case where a necessary pressure reduction is attained by only one stroke of the manual operating lever 35, the pressure reduction is presumed to be conducted instantaneously with velocity, so that a clear print-image is attained in a short operating time in contrast to an print-image by vacuum pump sucking.

Figure 6:
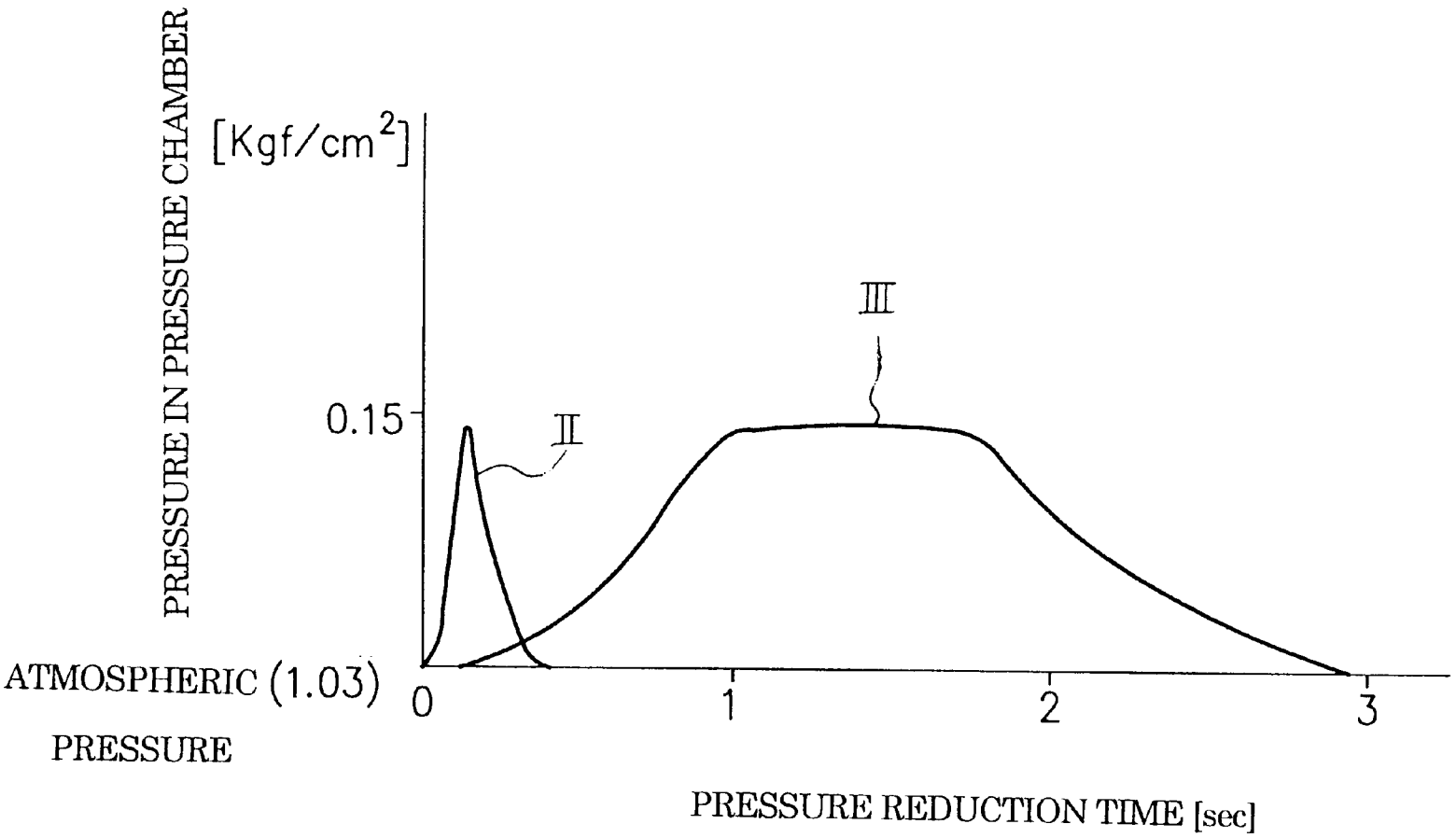
FIG. 6 is a graph showing a relation between pressure in the pressure reduction chamber and operating time for the reduction.
Figure 7:
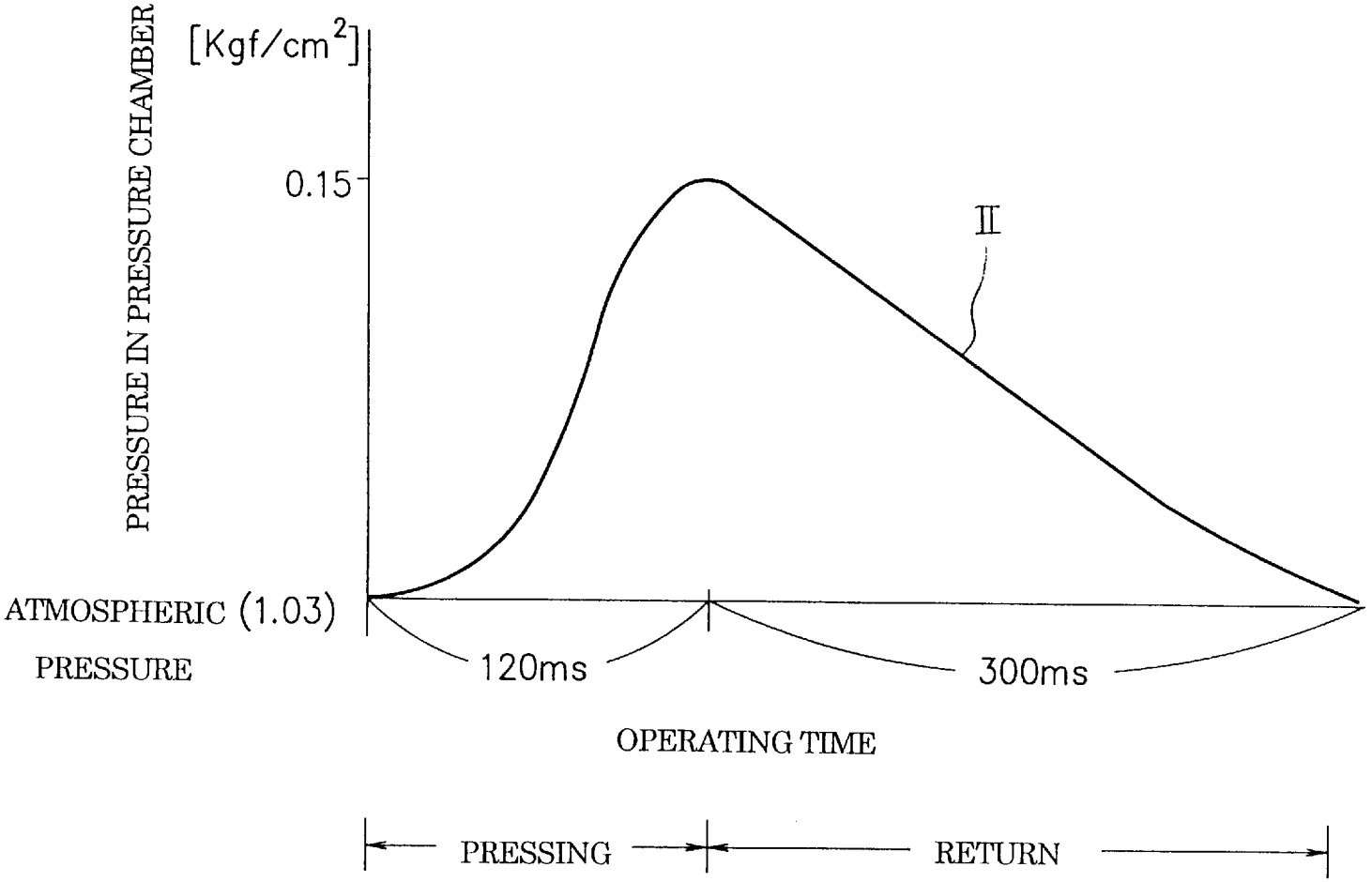
FIG. 7 is the curve II in the graph of FIG. 6 with the time base extended.

Now, FIG. 6 shows a graph showing a relation between pressure in the pressure reduction chamber S and operating time for the reduction. The curve III is the case where the pressure reduction means in the printing machine 1 of the present invention is replaced with a conventional vacuum pump. The curve II is the case where the printing machine 1 of the present invention functions. FIG. 7 shows the curve III in the graph of FIG. 6 with the time base extended. FIG. 6 clearly shows that the pressure reduction printing machine 1 of the present invention requires less time than the case of adopting the conventional vacuum pump to reduce pressure to a certain level in the pressure reduction chamber S. The lower the pressure in the pressure reduction chamber is, the higher the printing density is. Printing ink does not flow excessively since reduction pressure lasts only for a short time, so that printed material of high quality with less bleeding can be attained.

Figure 8:
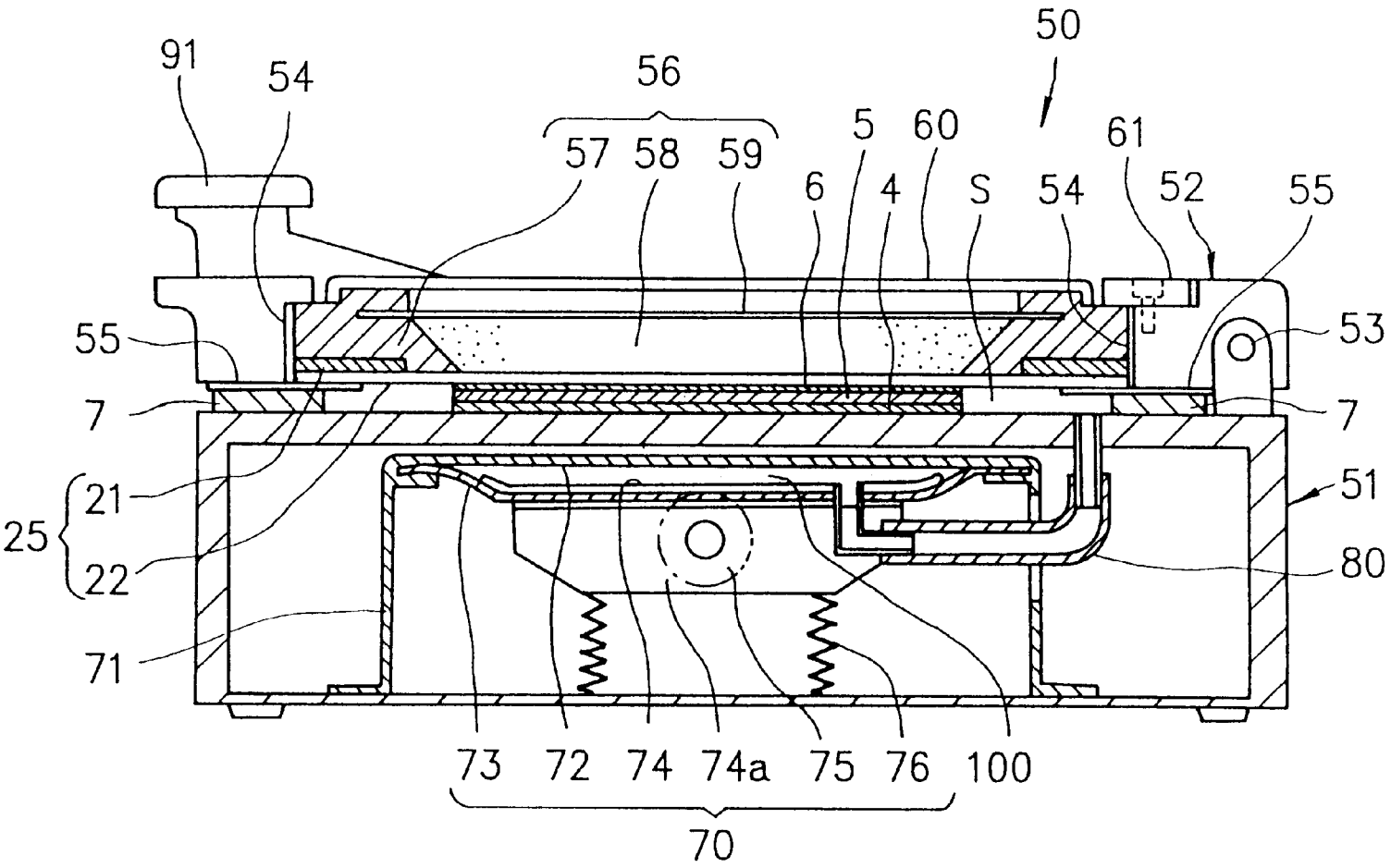
FIG. 8 is a sectional view of a stencil printing machine in the second embodiment of the present invention.
Figure 9:
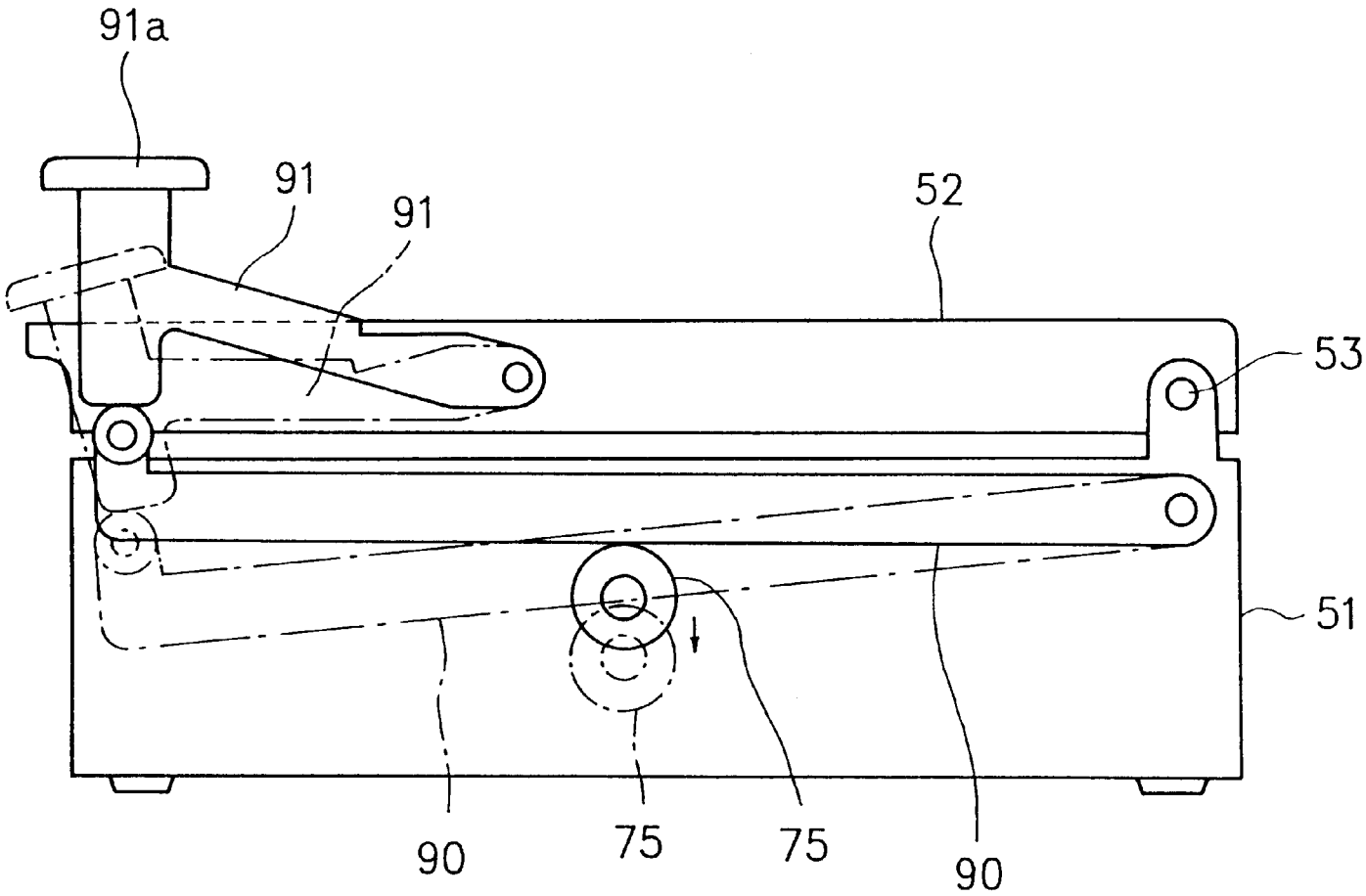
FIG. 9 is a side view illustrating a printing operation in the stencil printing machine of the second embodiment.

FIG. 8 is a sectional view of a pressure reduction printing machine 50 in the second embodiment of the present invention. FIG. 9 is an illustration of a printing operation by the pressure reduction printing machine 50. Hereinafter, different parts from the first embodiment will be mainly explained. For simplifying the description, the same parts as those of the first embodiment will be referred to by the same numbers as those of the first embodiment, and the explanation thereof will be omitted.

A main body 51 is a hollow box. A cover body 52 is pivotally attached on an upper surface of the main body 51 through a hinge 53. The cover body 52 is a frame having an opening 54 in the center thereof. A frame member 55 is disposed under a lower surface of the cover body 52. The frame member 55 protrudes inward of the opening 54. A stencil sheet assembly 25 is disposed inside the opening 54. The stencil sheet assembly 25 includes the frame 21 and the stencil sheet 22. The stencil sheet assembly 25 is placed on the frame member 55. The frame member 55 comes in close contact with the frame member 7 when the cover body 52 is superimposed on the main body 51.

An ink supply unit 56 is detachably attached inside the opening 54. The ink supply unit 56 includes a base 57 in a frame-form, ink 58 placed in the center and a flexible sheet 59 covering the surface of the ink 58. The numeral 60 shows a cover. The ink supply unit 56 is secured inside the opening 54 by a securing device 61. The ink supply unit 56 can be exchanged according to types and colors of the ink required.

An air pump 70 is disposed inside the main body 51. The air pump 70 has a box 71 inside the main body 51. A flexible bag 73 is disposed under a lower surface of an upper plate 72 of the box 71. The bag 73 has a bottom plate 74. The bottom plate 74 has plate portions 74*a* outside the bag 73. The plate portions 74*a* are disposed on both ends of the bag 73 extending in a direction of the hinge 53. Each plate portion 74*a* includes an engaging portion 75 of a roller shape. Between the each plate portion 74*a* and a bottom plate of the main body 51, a return spring 76 is disposed as return means. As shown in FIG. 8, when a force does not act downward to the bottom plate 74, the return spring 76 supports the bottom plate 74 in a horizontal position. At the time, an inner space 100 of the bag 73 is the smallest in volume.

The inner space 100 of the bag 73 is connected to the pressure reduction chamber S through a flexible pipe 80.

As shown in FIG. 9, a pair of manual operating levers 90, 90 is disposed on both sides of the main body 51 in the direction of the hinge 53. Rear ends of the pair of the manual operating levers 90, 90 are integrally connected through a driving axis which is parallel with the axial direction of the hinge 53. The pair of the manual operating levers 90, 90 is vertically swingable around the driving axis. The manual operating levers 90 engage an upper side of the engaging portion 75.

As shown in FIG. 9, a pair of operating members 91, 91 is disposed on both sides of the main body 51 in the direction of the hinge 53. Each point of application on the operating members 91, 91 is integrally connected through a crossbar 91*a* which is parallel with the axial direction of the hinge 53. A forward end (a driving point) on the operating member 91 engages a forward end of the manual operating lever 90. A roller is disposed on the forward end of the manual operating lever 90.

The manual operating levers 90 and the operating members 91 are horizontal in an operation start position, which is substantially in the same level as that of the closed cover body 52. At the time, the inner space 100 of the bag 73 is the smallest in volume. When the manual operating levers 90 are pressed downward from this position, the return spring 76 is compressed. When the force is released, the return spring 76 returns the manual operating levers 90 and the operating members to the operation start position.

As shown in FIG. 9 with an imaginary line, when the operating members 91 are pressed downward, the manual operating levers 90 are pressed to swing downward. The manual operating levers 90 press downward the engaging portion 75 while being swung downward. Thus, the bag 73 extends downward. The inner space 100 of the bag 73 increases in volume. Air in the pressure reduction chamber S flows into the inner space 100 and pressure in the chamber S is reduced.

The flexible sheet 59 is warped by atmospheric pressure, thereby pressing the stencil sheet assembly 20. Ink is pressed and transferred to the printing sheet 6 through the perforations of the stencil sheet 22. Printing is thus conducted.

According to the present invention, since pressure reducing means for reducing pressure in a pressure reduction chamber is installed under a main body, the whole constitution thereof is compacted. Further, since a position where a printing sheet is placed and an operating start position of a manual operating arm are substantially in the same level, printing operation can be conducted smoothly. According to a stencil printing machine of the present invention, a pressure in a reduction chamber is decreased instantaneously with velocity, so that stencil printing can be easily conducted on a printing sheet.

What is claimed is:

1. A stencil printing machine, comprising:

a main body having an upper surface for placing a printing sheet thereon;

a cover body openably attached to said upper surface of said main body, said cover body forming a space between said main body and said cover body for storing a stencil sheet and a printing sheet therein when said cover body is placed on said upper surface of said main body;

a flexible sheet attached to an upper surface side of said cover body so as to face said stencil sheet on said cover body;

pressure reducing means disposed under said main body so as to communicate with said space and including a swingable bottom plate pivotally attached to a lower surface of said main body at a rear end thereof and an extensible flexible bag disposed between an upper surface of said bottom plate and said lower surface of said main body, said pressure reducing means allowing atmospheric pressure to be exerted on said stencil sheet through said flexible sheet by reducing pressure in said space, thereby closely contacting said stencil sheet with said printing sheet to complete printing;

manual operating means attached to said pressure reducing means, said manual operating means being a front end portion of the bottom plate and operating said pressure reducing means when it is pressed downwardly from an operation start position that is substantially in a same level as said cover body; and return means for setting said bottom plate in said operation start position by urging said bottom plate upward.

2. A stencil printing machine as defined in claim 1, wherein said cover body includes a frame having an opening for receiving said stencil sheet, said flexible sheet being openably attached to an upper surface of said frame in such a manner that said flexible sheet closes said opening when printing is conducted.

3. A stencil printing machine as defined in claim 2, wherein said frame comprises an upper first frame having a first opening and a lower second frame disposed under said upper first frame and having a second opening, said second opening being smaller than said first opening and located inside said first opening;

said flexible sheet is openablly attached to an upper surface of said first frame in such a manner that said flexible sheet closes said first opening when printing is conducted;

said stencil sheet is a stencil sheet assembly comprising a frame having an outer shape fitting in said first opening, the stencil sheet attached to one face of said frame and a cover sheet openablly attached to the other face of said frame; and said stencil sheet assembly is mounted inside said first opening so that said stencil sheet is located at a bottom when printing is conducted.

4. A stencil printing machine as defined in claim 2, wherein an elastic adhesive layer is disposed on either one of said upper surface of said frame and a lower surface of said flexible sheet, and the other one of said upper surface of said frame and a lower surface of said flexible sheet is made from a resin sheet having a smooth surface.

5. A stencil printing machine, comprising:

a main body having an upper surface for placing a printing sheet thereon;

a cover body openably attached to said upper surface of said main body, said cover body forming a space between said main body and said cover body for storing a stencil sheet and a printing sheet therein when said cover body is placed on said upper surface of said main body;

a flexible sheet attached to an upper surface side of said cover body so as to face said stencil sheet on said cover body;

pressure reducing means disposed under said main body so as to communicate with said space and including an upper plate disposed under the main body, a vertically extendable flexible bag disposed on a lower surface of said upper plate, a bottom plate disposed under a lower side of said bag and an engaging portion disposed on the bottom plate, said pressure reducing means allowing atmospheric pressure to be exerted on said stencil sheet through said flexible sheet by reducing pressure in said space, thereby closely contacting said stencil sheet with said printing sheet to complete printing;

manual operating means attached to said pressure reducing means, said manual operating means being a manual operating lever pivotally attached to a side surface of said main body to be vertically swingable to engage an upper side of the engaging portion and operating said pressure reducing means when it is pressed downwardly from an operation start position that is substantially in a same level as said cover body; and return means for setting the manual operating lever in said operation start position by urging said bottom plate upward.

* * * * *